US008939739B2

(12) United States Patent
Kinoshita et al.

(10) Patent No.: US 8,939,739 B2
(45) Date of Patent: Jan. 27, 2015

(54) ELECTRIC COMPRESSOR

(75) Inventors: Yusuke Kinoshita, Kariya (JP); Shingo Enami, Kariya (JP); Ken Suitou, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 146 days.

(21) Appl. No.: 13/306,287

(22) Filed: Nov. 29, 2011

(65) Prior Publication Data

US 2012/0141307 A1 Jun. 7, 2012

(30) Foreign Application Priority Data

Dec. 2, 2010 (JP) ..... 2010-269514

(51) Int. Cl.

| | |
|---|---|
| ***F04B 35/04*** | (2006.01) |
| ***F04B 39/00*** | (2006.01) |
| ***F04C 23/00*** | (2006.01) |
| ***F04C 29/04*** | (2006.01) |

(52) U.S. Cl.

CPC ..... *F04C 23/008* (2013.01); *F04C 29/045* (2013.01); *F04C 2240/803* (2013.01); *F04C 2240/808* (2013.01)

USPC ..... 417/423.7; 310/68 R

(58) Field of Classification Search

CPC ..... F04B 17/03; F04B 35/04; H02K 5/225; H02K 11/02

USPC ..... 417/423.7, 423.14; 310/68 R

See application file for complete search history.

(56) References Cited

U.S. PATENT DOCUMENTS

| | | | | |
|---|---|---|---|---|
| 5,949,663 | A | 9/1999 | Endo et al. | |
| 6,704,202 | B1 | 3/2004 | Hamaoka et al. | |
| 2002/0025265 | A1 | 2/2002 | Ikeda | |
| 2003/0200761 | A1 | 10/2003 | Funahashi et al. | |
| 2004/0108779 | A1 * | 6/2004 | Boettger et al. | 310/89 |
| 2005/0223727 | A1 | 10/2005 | Funahashi et al. | |
| 2006/0064998 | A1 | 3/2006 | Funahashi et al. | |
| 2009/0126185 | A1 * | 5/2009 | Chung et al. | 29/605 |

(Continued)

FOREIGN PATENT DOCUMENTS

| | | | |
|---|---|---|---|
| CN | 1721701 | A | 1/2006 |
| CN | 101463807 | A | 6/2009 |

(Continued)

OTHER PUBLICATIONS

Extended European Search Report for corresponding EP Patent Application No. 11191042.8 dated Mar. 23, 2012.

(Continued)

*Primary Examiner* — Bryan Lettman

(74) *Attorney, Agent, or Firm* — Sughrue Mion, PLLC

(57) ABSTRACT

An electric compressor includes a compression mechanism, an electric motor for driving the compression mechanism, and a drive circuit for controlling the electric motor. The drive circuit includes an external connector made of an insulating material. The external connector has a connecting terminal that is constructed to be electrically connected to an external power source. The drive circuit further includes a circuit board electrically connected to the connecting terminal and a filter element electrically connected to the circuit board. The drive circuit is accommodated in a metal housing. The filter element is integrally formed with the external connector such that contact of the filter element with the housing is prevented.

5 Claims, 2 Drawing Sheets

(56) References Cited

U.S. PATENT DOCUMENTS

| | | | | |
|---|---|---|---|---|
| 2009/0155101 | A1* | 6/2009 | Fukasaku et al. | 417/410.1 |
| 2010/0209266 | A1 | 8/2010 | Ikeda et al. | |
| 2011/0256002 | A1 | 10/2011 | Ikeda | |

FOREIGN PATENT DOCUMENTS

| | | | |
|---|---|---|---|
| CN | 101809286 | A | 8/2010 |
| EP | 1 164 665 | A1 | 12/2001 |
| EP | 1 571 736 | A1 | 9/2005 |
| EP | 1 617 081 | A2 | 1/2006 |
| EP | 2 204 581 | A1 | 7/2010 |
| JP | 11-041943 | A | 2/1999 |
| JP | 2000-357890 | A | 12/2000 |
| JP | 2002-070743 | A | 3/2002 |
| JP | 2004-190525 | A | 7/2004 |
| JP | 2006-237135 | A | 9/2006 |
| JP | 2007-309125 | A | 11/2007 |
| JP | 2009-187824 | A | 8/2009 |
| JP | 2009-259553 | A | 11/2009 |
| JP | 2010-093202 | A | 4/2010 |
| JP | 2010144607 | A | 7/2010 |

OTHER PUBLICATIONS

Chinese Office Action dated Nov. 26, 2013 issued in corresponding Chinese Patent Application No. 201110385226.4.

Office Action dated Jul. 10, 2014, issued by the State Intellectual Property Office of the People's Republic of China in corresponding application 201110385226.4.

* cited by examiner

ELECTRIC COMPRESSOR

ART OF THE DISCLOSURE

The present disclosure relates to an electric compressor. An electric compressor includes a compression mechanism, an electric motor for driving the compression mechanism, and a drive circuit for controlling the electric motor.

BACKGROUND

The drive circuit of this type of electric compressor is accommodated in a metal housing. The drive circuit has an external connector to be electrically connected to a vehicle battery, which is an external power source. Electrical components on the circuit board receive electric power via the external connector. An inverter circuit for driving the electric motor and a switching element for performing switching control of the inverter circuit are mounted on the circuit board. Also, a filter coil and filter capacitors are mounted on the circuit board. The filter coil and the filter capacitors are filter elements, which protect switching elements from instantaneous and excessive currents and reduce noise.

As described above, a great number of electric circuits and electrical components are mounted on the circuit board of a drive circuit. Since the sizes of filter coils and filter capacitors are large, the circuit board has adhesive applied thereon to reduce vibration and parts having auxiliary functions for fixing the board with bolts. As a result, circuit boards tend to be large.

Accordingly, to reduce the size of circuit boards, for example, Japanese Laid-Open Patent Publication No. 2007-309125 discloses an on-vehicle electric circuit unit mounted on an electric compressor. A circuit board and electric elements are accommodated in a housing formed by an upper case and a lower case. A power inputting terminal is fixed to the upper case. The power inputting terminal is an external connector that is electrically connected to an external power source. The power inputting terminal is also connected to a filter coil, filter capacitors, and an inverter control board, which is a circuit board, via a busbar.

The filter coil of an on-vehicle electric circuit unit is fixed to the upper surface of the upper case with fixing members. The filter capacitors are fixed to a side of the upper case with other fixing members. Therefore, compared to, for example, a case where a filter coil and filter capacitors are mounted on one component side of an inverter control board, the size of the component side is reduced. That is, the size of the inverter control board is reduced.

However, according to the electric compressor disclosed in the document, the filter coil and the filter capacitors are fixed to the upper case, or to the housing, while being pressed against the inner wall of the upper case. Therefore, when the coatings of the filter capacitors and the filter coil are worn due to vibrations applied from the outside, the electrical insulation of the housing, which contacts the filter capacitors and the filter coil, is difficult to maintain.

SUMMARY

Accordingly, it is an objective of the present invention to reduce the size of a circuit board and maintain the insulation of circuit board components from a housing in an electric compressor.

An electric compressor disclosed herein includes a compression mechanism, an electric motor that drives the compression mechanism, and a drive circuit for controlling the electric motor. The drive circuit includes an external connector, a circuit board, and a filter element. The external connector is made of an insulating material, and has a connecting terminal constructed to be electrically connected to an external power source. The circuit board is electrically connected to the connecting terminal. The filter element is electrically connected to the circuit board. The drive circuit is accommodated in a metal housing. The filter element is integrally molded with the external connector such that contact of the filter element with the housing is prevented.

According to this configuration, the external connector prevents filter elements from contacting the metal housing. This ensures the electrical insulation of the filter elements from the housing. Also, the filter elements are integrally formed with the external connector. Thus, the size of the circuit board is reduced compared to a case where all the filter elements are mounted on the same component side of a circuit board.

In accordance with one aspect, the filter element comprises at least one of a coil and a capacitor.

According to this configuration, at least one of a coil and a capacitor is formed integrally with the external connector. A filter element is thus embedded in the external connector, and the external connector is interposed between the filter element and the housing. Accordingly, for example, vibrations applied from outside are prevented from damaging the filter element.

In accordance with one aspect, the electric compressor further includes a conducting member that extends through the housing and is electrically connected to the electric motor, and a board connector that is arranged in the housing and electrically connected to the circuit board. The conducting member is connected to the board connector, so that the electric motor is electrically connected to the circuit board. The board connector is integrated with the external connector.

According to this configuration, most of the members about the circuit board are permitted to be integrated. Accordingly, the drive circuit is easily installed in the housing.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 1(*b*) is an enlarged view illustrating the inverter unit shown in FIG. 1(*a*);

DESCRIPTION OF THE PREFERRED EMBODIMENTS

Figure 1:
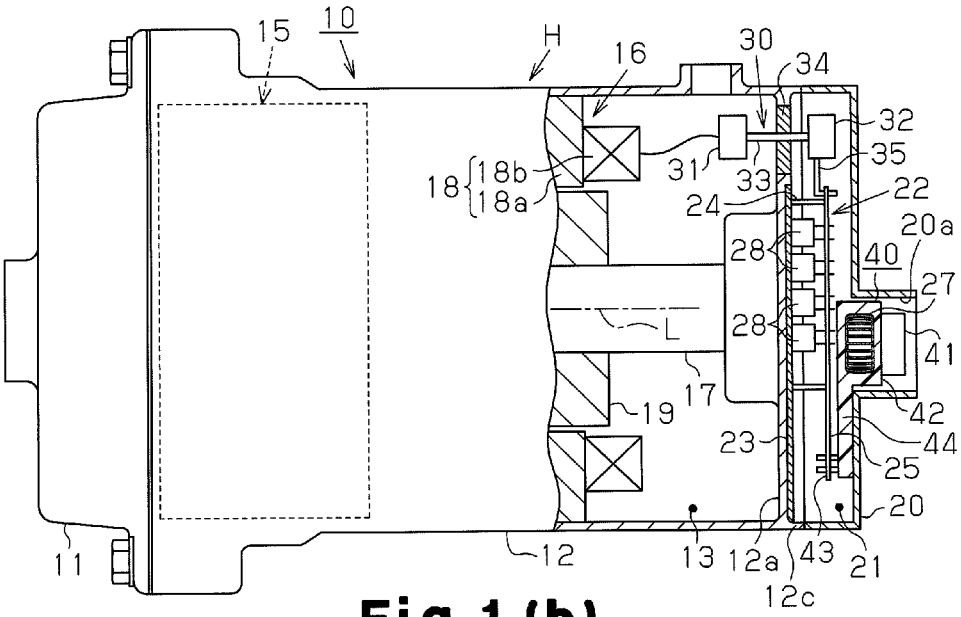
FIG. 1(*a*) is a partial cross-sectional view, with a part cut away, illustrating an electric compressor according to a first embodiment.
Figure 1:
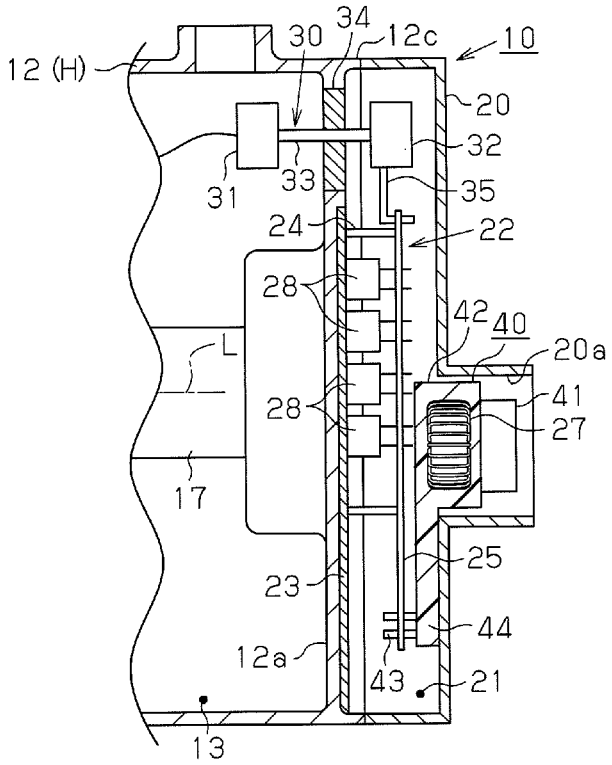

FIGS. 1(*a*) and 1(*b*) show a first embodiment. In these drawings, the axial direction of an electric compressor 10, that is, the direction along which the axis L of a rotary shaft 17 of the electric compressor 10 extends, is the left-right direction.

As shown in FIG. 1(*a*), the electric compressor 10 includes a first housing 11 and a second housing 12. The second housing 12 has a cylindrical shape with a closed end, and the first housing 11 closes the open end, or the left end as viewed in FIG. 1(*a*) of the second housing 12. The first housing 11 also has a cylindrical shape with a closed end. The second housing 12 accommodates an electric motor 16, which is arranged at a position close to a bottom wall 12*a*, and a compression mechanism 15, which is arranged at a position close to the first housing 11. That is, the second housing 12 is a motor housing for accommodating the electric motor 16. The interior of the second housing 12 is a motor accommodating space 13 for accommodating the electric motor 16. In the present embodiment, the electric compressor 10 is a scroll compressor.

A stator 18 of the electric motor 16 is fixed to the inner circumferential surface of the second housing 12. The stator 18 has a stator core 18*a* and a motor coil 18*b* wound about the stator core 18*a*. The rotary shaft 17 is rotatably supported by the second housing 12 via bearings (not shown). A rotor 19 of the electric motor 16 is fixed to the rotary shaft 17 to rotate integrally with the rotary shaft 17. When the electric motor 16 is driven to rotate the rotary shaft 17, the compression mechanism 15 is activated to compress, for example, refrigerant of a vehicle air conditioner.

An inverter cover 20 having a box-like shape with a closed end is secured to the bottom wall 12*a* on the right side of the second housing 12 in FIG. 1(*a*). The first housing 11, the second housing 12, and the inverter cover 20 are made of aluminum and form a housing H of the electric compressor 10. The bottom wall 12*a* and the inverter cover 20 define a circuit accommodating space 21. The circuit accommodating space 21 accommodates an inverter unit 22, which is a drive circuit for driving the electric motor 16. That is, the bottom wall 12*a* functions as a partition wall that divides the motor accommodating space 13, which accommodates the electric motor 16, and the circuit accommodating space 21, which accommodates the inverter unit 22, from each other. The inverter cover 20 is a circuit cover that is secured to the second housing 12 to cover the bottom wall 12*a*, which serves as a wall of the second housing 12.

More specifically, as shown in FIGS. 1(*a*) and 1(*b*), the bottom wall 12*a* of the second housing 12 is slightly inward (leftward as viewed in the drawing) from the axial end of the circumferential wall of the second housing 12. That is, the second housing 12 has a circumferential wall 12*c* that extends axially outward (rightward as viewed in the drawing) from the bottom wall 12*a*. The open end of the circumferential wall 12*c* (the right end as viewed in the drawing) is joined to the open end of the inverter cover 20 (the left end as viewed in the drawing). In this manner, the bottom wall 12*a*, the circumferential wall 12*c*, and the inverter cover 20 define the circuit accommodating space 21. In the present embodiment, the compression mechanism 15, the electric motor 16, and the inverter unit 22 are arranged in the order along the axial direction of the rotary shaft 17. The inverter cover 20 has a power input port 20*a*, which exposes the circuit accommodating space 21 to the outside.

As shown in FIG. 1(*b*), a plate-like heat removing member 23 is joined to the bottom wall 12*a* to extend along the bottom wall 12*a*. The inverter unit 22 is attached to the heat removing member 23. The heat removing member 23 is made of aluminum having a high thermal conductivity and thermally coupled to the bottom wall 12*a*. A board support member 24 is fixed to the heat removing member 23 to support a circuit board 25 of the inverter unit 22. That is, while being separated from the heat removing member 23, the circuit board 25 is thermally coupled to the heat removing member 23 via the board support member 24. The circuit board 25 is arranged to be perpendicular to the axial direction of the electric compressor 10.

The circuit board 25 is electrically connected to filter elements, which are a filter coil 27 and filter capacitors 28. The filter capacitors 28 contact the heat removing member 23.

That is, the filter capacitors 28 are mounted on the circuit board 25 without contacting any of the bottom wall 12*a*, the circumferential wall 12*c*, and the inverter cover 20. Thus, contact of the filter capacitors 28 with the housing H is prevented. Although omitted to simplify the description, the circuit board 25 is electrically connected to an inverter circuit (not shown), which is a drive control circuit for the electric motor 16, and switching elements (not shown).

The circuit board 25 is electrically connected to the motor coil 18*b* by a sealed terminal 30, which extends through the bottom wall 12*a* of the second housing 12. The sealed terminal 30 is located above the circuit board 25 as viewed in the drawing. The sealed terminal 30 is fixed to extend through an insulating member 34 formed on the bottom wall 12*a*. The sealed terminal 30 has a motor connector 31, which is electrically connected to the motor coil 18*b* via a lead 31*a*, a board connector 32, which is electrically connected to the circuit board 25 via a connecting member 35, and a conducting member 33, which connects the motor connector 31 to the board connector 32. The conducting member 33 extends through the insulating member 34. That is, the insulating member 34 fixes the conducting member 33 to the bottom wall 12*a*, while insulating the conducting member 33 from the bottom wall 12*a*. In this manner, the conducting member 33 extends through the bottom wall 12*a*, which forms a part of the housing H.

The circuit board 25 has an external connector 40 to be electrically connected to a vehicle battery, which is an external power source. The external connector 40 is made of a resin material, that is, an insulating material, and has an external connecting terminal 41 to be electrically connected to the outside. The external connecting terminal 41 is located inside the power input port 20*a*. That is, the outer shell of the external connector 40 is formed of a resin material. The external connecting terminal 41 is arranged in the power input port 20*a* to face the outside of the circuit accommodating space 21. The external connector 40 is electrically connected to a power inputting portion of the circuit board 25 via a connecting member 43. The external connector 40 has a terminal holding portion 44, which extends along the bottom wall 12*a* from the external connecting terminal 41 to the connecting member 43, and the terminal holding portion 44 contacts the inverter cover 20. Since they are supported and held between the bottom wall 12*a* and the inverter cover 20, the inverter unit 22 and the external connector 40 resist vibration.

The filter coil 27 is embedded in resin in the external connector 40. The external connector 40 has a resin coil holding portion 42, which is located on a side of the external connecting terminal 41 and relatively close to the circuit accommodating space 21, and the coil holding portion 42 holds the filter coil 27 therein.

The external connector 40 of the present embodiment is a molded resin product that is integrated with the filter coil 27 through molding. A method for manufacturing the external connector 40 is as follows. With the filter coil 27 placed in a mold (not shown) for manufacturing the external connector 40, molten resin is poured into the mold and then hardened. As a result, the filter coil 27 is embedded in the coil holding portion 42.

The filter coil 27 is electrically connected to the circuit board 25 and the external connecting terminal 41 via a busbar incorporated in the terminal holding portion 44.

Operation of the inverter unit 22 will now be described.

Electric power is supplied from a vehicle battery to the inverter unit 22 via the external connecting terminal 41. Then, the drive control circuit controls the operation of the electric motor 16 to drive the compression mechanism 15. During such supply of electric power, the filter coil 27 and the filter capacitors 28 protect the switching elements from instantaneous and excessive currents and reduce extrinsic noise.

As described above, the filter coil 27 is embedded in the resin external connector 40. The filter capacitors 28 are mounted on the circuit board 25 while in contact with the heat removing member 23. In this manner, the filter coil 27 and the filter capacitors 28 are insulated from the housing H of the electric compressor 10.

The above described first embodiment has the following advantages.

(1) In the electric compressor 10, the filter capacitors 28, which are filter elements, are mounted on the circuit board 25 and are not in contact with the housing H. The housing H is formed by the bottom wall 12*a*, the circumferential wall 12*c*, and the inverter cover 20. The filter coil 27, which is another filter element, is integrated with the external connector 40 through molding. That is, the external connector 40 is molded integrally with the filter coil 27 with resin so that the filter coil 27 is embedded in the external connector 40. Therefore, contact of the filter coil 27 with the housing H (the bottom wall 12*a*, the circumferential wall 12*c*, and the inverter cover 20) is prevented. Therefore, in the electric compressor 10, the electrical insulation between the housing H and the filter elements (the filter coil 27 and the filter capacitors 28) is ensured. Only the filter capacitors 28 are mounted on the component side of the circuit board 25. This reduces the size of the circuit board 25 compared to a case where both of the filter capacitors 28 and the filter coil 27 are mounted on the same component side of the circuit board 25.

(2) The filter coil 27 is integrated with the external connector 40 through molding. The filter coil 27 is electrically connected to the circuit board 25 via the connecting member 43 of the external connector 40. The filter capacitors 28 are soldered to the circuit board 25. Therefore, the number of soldering spots has been reduced in the present embodiment compared to a case where the filter coil 27 and the filter capacitors 28 are both soldered to the circuit board 25.

(3) The filter coil 27, which is a filter element, is integrated with the external connector 40 through molding, to be held by the external connector 40. That is, the resin part of the external connector 40 is located between the filter coil 27 and the inverter cover 20. Accordingly, for example, vibrations applied from outside are prevented from damaging the filter coil 27. In this manner, the external connector 40 reduces vibration of the filter coil 27. Since the filter coil 27 does not need to be attached to the circuit board 25 with adhesive or a bolt designed for reducing vibration, the size of the circuit board 25 has been reduced.

(4) Of the filter coil 27 and the filter capacitors 28, which are filter elements, the filter capacitors 28 are supported by being held in contact with the heat removing member 23 while being mounted on the circuit board 25. The filter coil 27 is embedded in the external connector 40. Therefore, the positions of the filter coil 27 and the filter capacitors 28 are determined without using any fixing members. Therefore, compared to a case where the positions of a filter coil and filter capacitors are both determined by fixing members, the number of components of the inverter unit 22 in the electric compressor 10 has been reduced.

(5) The inverter unit 22 is used to control the operation of the electric motor 16 of the electric compressor 10. The filter coil 27 is a relatively heavy electrical component. Therefore, the filter coil 27 is likely to vibrate when the compression mechanism 15 or the electric motor 16 operates. In the present embodiment, the filter coil 27 is integrated with the external connector 40 through molding, which reduces vibration of the filter coil 27.

Figure 2:
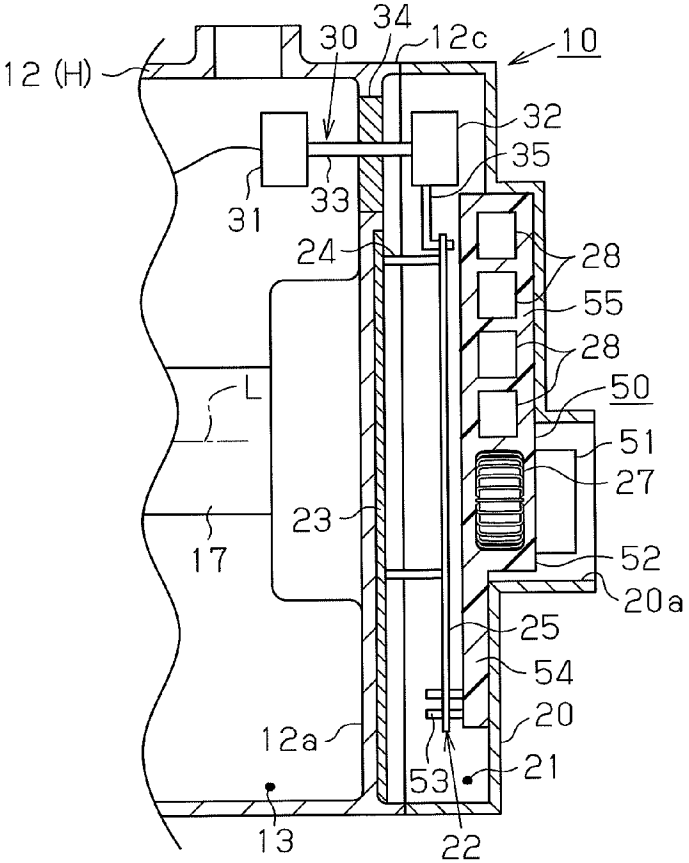
FIG. 2 is a cross-sectional view illustrating an inverter unit according to a second embodiment.

FIG. 2 shows a second embodiment. The second embodiment is different from the first embodiment in that both of the filter coil 27 and the filter capacitors 28 are integrated with an external connector 50 through molding. Like or the same reference numerals are given to those components that are like or the same as the corresponding components of the first embodiment.

Like the external connector 40 of the first embodiment, the external connector 50 of the second embodiment includes an external connecting terminal 51, a coil holding portion 52, and a terminal holding portion 54, which are formed integrally, a shown in FIG. 2. Further, a capacitor holding portion 55 for holding the filter capacitors 28 is integrally formed with the external connector 50. The coil holding portion 52, the terminal holding portion 54, and the capacitor holding portion 55 extend along the bottom wall 12*a* of the second housing 12. A connecting member 53, which is integrated with the terminal holding portion 54, is electrically connected with the circuit board 25. The filter coil 27 and the filter capacitors 28 are electrically connected to the circuit board 25 and the external connecting terminal 41 via a busbar incorporated in the terminal holding portion 54.

The second embodiment thus has the following advantages.

(6) The filter coil 27 and the filter capacitors 28, which are filter elements, are integrated with the resin external connector 50 through molding. The filter coil 27 and the filter capacitors 28 do not contact the housing H. That is, contact of the filter coil 27 and the filter capacitors 28 with any of the bottom wall 12*a*, the circumferential wall 12*c*, and the inverter cover 20 is prevented. Therefore, the electrical insulation between the housing H and the filter elements (the coil 27 and the filter capacitors 28) is ensured. In this embodiment, neither the filter coil 27 nor the filter capacitors 28 is mounted on the component side of the circuit board 25. Thus, the circuit board 25 of the present embodiment has been reduced in size compared to a case where at least either of the filter capacitors 28 and the filter coil 27 is mounted on the same component side of the circuit board 25.

(7) The filter coil 27 and the filter capacitors 28 are both integrated with the external connector 50 through molding. The filter coil 27 and the filter capacitors 28 are electrically connected to the circuit board 25 via the connecting member 53 of the external connector 50. Therefore, the number of soldering spots has been reduced in the present embodiment compared to a case where at least either of the filter coil 27 and the filter capacitors 28 are soldered to the circuit board 25.

(8) The filter coil 27 and the filter capacitors 28, which are filter elements, are both integrated with the external connector 50 through molding. That is, the resin part of the external connector 40 is located between the filter coil 27 and the inverter cover 20 and between the filter capacitors 28 and the inverter cover 20. Accordingly, for example, vibrations applied from outside are prevented from damaging the filter coil 27 and the filter capacitors 28. That is, there is no need for the filter coil 27 or the filter capacitors 28 to be attached to the circuit board 25 with adhesive or bolts designed for reducing vibration. Therefore, the size of the circuit board 25 has reduced.

(9) The filter coil 27 and the filter capacitors 28, which are filter elements, are both integrated with the external connector 50 through molding. That is, the positions of the filter coil 27 and the filter capacitors 28 are determined without using any fixing members. Therefore, compared to a case where the position of the filter coil 27 or the positions of the filter capacitors 28 are determined by using fixing members, the number of components of the inverter unit 22 in the electric compressor 10 is reduced.

(10) The inverter unit 22 is used to control the operation of the electric motor 16 of the electric compressor 10. The filter coil 27 and the filter capacitors 28 are relatively heavy electrical components. Therefore, the filter coil 27 and the filter capacitors 28 are likely to vibrate when the compression mechanism 15 or the electric motor 16 operates. In the present embodiment, the filter coil 27 and the filter capacitors 28 are both incorporated in the external connector 50. Therefore, vibration of both the filter coil 27 and the filter capacitors 28 is reduced.

Figure 3:
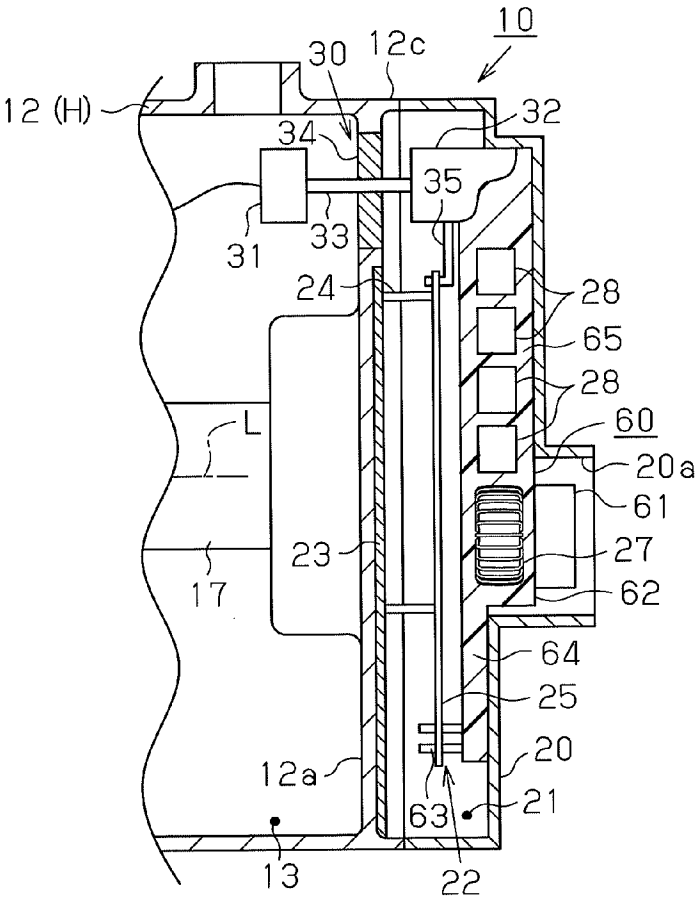
FIG. 3 is a cross-sectional view illustrating an inverter unit according to a third embodiment.

FIG. 3 shows a third embodiment. A capacitor holding portion 65 of the third embodiment is integrally formed with the board connector 32 of the sealed terminal 30. That is, the external connector 60 of third embodiment is different from the second embodiment in that the sealed terminal 30 is integrated with the external connector 60. Like or the same reference numerals are given to those components that are like or the same as the corresponding components of the second embodiment.

Like the second embodiment, the external connector 60 of the third embodiment includes an external connecting terminal 61, a coil holding portion 62, and a terminal holding portion 64, which are formed integrally, a shown in FIG. 3. The filter coil 27 and the filter capacitors 28 are integrated with the external connector 60 through molding. A connecting member 63, which is integrated with the terminal holding portion 64, is electrically connected with the circuit board 25.

In addition to the advantages of the second embodiment, the third embodiment has the following advantage.

(11) The board connector 32 is integrated with the external connector 60. Therefore, most of the components accommodated in the circuit accommodating space 21, that is, most of the components about the circuit board 25, are integrated. This permits the inverter unit 22 to be easily installed in the electric compressor 10.

The present embodiments may be modified as follows.

In the first embodiment, the board connector 32 may be integrated with the external connector 40.

Only the filter capacitors may be integrated with an external connector though molding. A filter coil is mounted to the circuit board 25 in any manner as long as contact of the filter coil with any of the bottom wall 12*a*, the circumferential wall 12*c*, and the inverter cover 20 is prevented.

As long as the insulating property is maintained, the external connectors 40, 50, 60 do not need to be formed of resin. For example, ceramics may be used as necessary.

The invention claimed is:

1. An electric compressor, comprising:

a compression mechanism;

an electric motor that drives the compression mechanism; and a drive circuit for controlling the electric motor, wherein the drive circuit includes:

an external connector made of an insulating material, the external connector having a connecting terminal constructed to be electrically connected to an external power source;

a circuit board electrically connected to the connecting terminal; and a filter element electrically connected to the circuit board, the drive circuit is accommodated in a metal housing, and the external connector is integrally molded as a single component with the filter element, the filter element embedded in the external connector, such that electrical contact of the filter element with the housing is prevented, and wherein the housing includes a motor housing for accommodating the electric motor and a circuit cover that is joined to the motor housing, the circuit cover is provided with the external connector;

the circuit cover accommodates the filter element;

the filter element comprises a coil and a capacitor, the coil and the capacitor are both integrated with the external connector, and the coil and the capacitor are arranged along an inner surface of the circuit cover.

2. The electric compressor according to claim 1, further comprising:

a conducting member that extends through the housing and is electrically connected to the electric motor; and a board connector that is arranged in the housing and electrically connected to the circuit board, wherein the conducting member is connected to the board connector, so that the electric motor is electrically connected to the circuit board, and the board connector is integrated with the external connector.

3. The electric compressor according to claim 2, wherein the housing has a partition wall, which defines an accommodating space for accommodating the electric motor and a circuit accommodating space for accommodating the drive circuit, and the conducting member extends through the partition wall.

4. The electric compressor according to claim 1, wherein the housing includes the motor housing for accommodating the electric motor and the circuit cover that is joined to the motor housing to cover a wall of the motor housing, the wall and the circuit cover defining a circuit accommodating space for accommodating the drive circuit, the circuit board is supported in relation to the wall by a support member and is separated from the wall, and the external connector is arranged to contact the circuit cover, so that the drive circuit and the external connector are supported between the wall and the circuit cover.

5. The electric compressor according to claim 1, wherein an outer shell of the external connector is formed of resin.

* * * * *